US006909078B2

(12) United States Patent
Lee et al.

(10) Patent No.: US 6,909,078 B2
(45) Date of Patent: Jun. 21, 2005

(54) COOKING CHAMBER ASSEMBLY IN MICROWAVE OVEN

(75) Inventors: Sang Ryul Lee, Masan-si (KR); Duck Gil Lee, Changwon-si (KR)

(73) Assignee: LG Electronics Inc., Seoul (KR)

( * ) Notice: Subject to any disclaimer, the term of this patent is extended or adjusted under 35 U.S.C. 154(b) by 5 days.

(21) Appl. No.: 10/628,285

(22) Filed: Jul. 29, 2003

(65) Prior Publication Data

US 2004/0149749 A1 Aug. 5, 2004

(30) Foreign Application Priority Data

Dec. 27, 2002 (KR) ..... 10-2002-0085106
Dec. 30, 2002 (KR) ..... 10-2002-0086907

(51) Int. Cl.[7] ..... H05B 6/72
(52) U.S. Cl. ..... 219/756; 219/757
(58) Field of Search ..... 219/756, 757, 219/763, 762, 733, 734, 391, 400; 99/444, 446

(56) References Cited

U.S. PATENT DOCUMENTS 4,556,772 A * 12/1985 McCammon et al. ..... 219/757
4,857,685 A * 8/1989 Vigano et al. ..... 219/707

FOREIGN PATENT DOCUMENTS

JP 58-116905 8/1983
JP 08090669 A * 4/1996 ..... B29D/22/00
JP 2000154920 A * 6/2000 ..... F24C/7/02

* cited by examiner

*Primary Examiner*—Quang T. Van
(74) *Attorney, Agent, or Firm*—Fleshner & Kim LLP

(57) ABSTRACT

A cooking chamber assembly in a microwave oven for improved which improves air tightness in the cooking chamber, and reduces assembly complexity, time, and cost. A tray which essentially forms a bottom surface of a cooking chamber of the microwave oven is surrounded by a unitary gasket. A groove formed in an inner edge of the unitary gasket is designed to receive an outer edge of the tray, and a lip formed on an outer edge of the unitary gasket is designed to provide an air tight seal with an inner surface of a case of the cooking chamber. An air duct which guides circulating air is attached to an inner portion of the case with a series of hooks, allowing the air duct to be attached without separate fastening members such as screws or bolts, thus further reducing manufacturing time and cost.

17 Claims, 8 Drawing Sheets

COOKING CHAMBER ASSEMBLY IN MICROWAVE OVEN

This application claims the benefit of the Korean Application Nos. P2002-85106 filed on Dec. 27, 2002, and P2002-86907 filed on Dec. 30, 2002, which are hereby incorporated by reference.

BACKGROUND OF THE INVENTION

1. Field of the Invention

The present invention relates to microwave ovens, and more particularly, to a cooking chamber assembly in a microwave oven of which ceiling and air duct assembly are improved.

2. Background of the Related Art

The microwave oven defrosts or heats food by directing a microwave to the food, that causes molecules in the food to vibrate to generate frictional heat for the defrosting or the heating.

FIG. 1 illustrates a partly disassembled perspective view of a related art microwave oven. As shown, the microwave oven is provided with a base plate 10, a front plate 15 and a rear plate 13 mounted on a front end and a rear end of the base plate 10 vertical thereto respectively, an inner case 17 between the front plate 15 and the rear plate 13 to form a cooking chamber 20 therein, an outfit chamber 30 formed over the base plate 10 and sides of the inner case 17, a front panel 40 attached to the front plate 15, a plurality of electric components in the outfit chamber 30, and an outer case 45 for enclosing the inner case 17 and the outfit chamber 30.

The front plate has an opening 16 for making the cooking chamber 20 in communication with an exterior, and a door 41 on the front panel 40 for closing the opening 16.

The outfit chamber 30 is provided with a magnetron 31 for generating and directing a microwave to the cooking chamber 20, a transformer 32 for boosting a voltage of an external power and supplying to the magnetron 31, and a cooling fan 33 for cooling various components.

The cooking chamber 20 of the microwave oven may sometimes be provided with a ceramic tray 50 on a bottom thereof and an air duct 60 on a ceiling thereof for circulating air in the cooking chamber 20. Structures for mounting the ceramic tray 50 and the air duct 60 to the cooking chamber 20 will be described, briefly.

FIG. 2 or 3 illustrates a structure for mounting the tray 50 in the cooking chamber 20. As shown in FIG. 2, the tray 50 is mounted on the bottom of the cooking chamber 20 together with a plurality of gaskets 55. The gaskets 55, for an example, of silicone rubber, are provided to four sides of the tray 50. The gaskets 55 are put inside of the cooking chamber 20, together with the tray 50, and sealant 56 is applied to corners of the tray 50 where the gaskets 55 abut.

However, the application of the sealant is not convenient in above structure, failing to cover the abutting parts of the gaskets 55, perfectly. Then, as shown in FIG. 3, there may be a small gap 57 formed between the gaskets 55, a corner of the cooking chamber 17, and the sealant 56. Then, water or dirt may infiltrate therein, which is not sanitary, and may caused rust, or out of order of components when intensive. Moreover, the applied sealant 56 or the gap 57 harms a sense of beauty of the cooling chamber 20, and drops consumer satisfaction.

In the meantime, referring to FIG. 4, the air duct 60 is mounted on an underside of a ceiling of the cooking chamber 20. The air duct 60 draws in external air, circulates the air inside of the cooking chamber 20, for prevention of formation of dew on the door 41 during cooking, and discharging smell and smoke from food to an exterior. To do this, the air duct 60 has inlets 61 for introducing the external air passed through the outfit chamber 30 into the cooking chamber 20, and outlets 62 for drawing the air circulated inside of the cooking chamber 20 and discharging to an exterior.

Such an air duct 60, in general formed of plastic, is fastened to an underside of ceiling with fastening members 63, such as screws, as shown in FIG. 4. However, such a fastening structure requires many assembly components, and a complicated assembly process, and time, which drops productivity.

SUMMARY OF THE INVENTION

Accordingly, the present invention is directed to a cooking chamber assembly in a microwave oven that substantially obviates one or more of the problems due to limitations and disadvantages of the related art.

An object of the present invention, designed for solving the foregoing problems, lies on providing a cooking chamber assembly in a microwave oven, which has an improved structure that can prevent formation of a gap between a wall of a cooking chamber case and a tray.

Another object of the present invention is to provide a cooking chamber assembly in a microwave oven, which has an improved air duct mounting structure that enables direct attachment of the air duct on an underside of ceiling of a cooling chamber case without separate fastening member.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the cooking chamber assembly in a microwave oven, includes a case, a tray, and a gasket. The case has a cooking chamber formed therein and an opening in a front part. The tray is provided in the case to form a bottom of the cooking chamber. The gasket formed as one unit has an inner edge surrounding an edge of the tray, and a part of outer surface in close contact with an inside surface of the case.

The gasket includes a groove caved along the inner edge for inserting the edge of the tray.

The gasket may further includes a lip projected from the outer edge of the gasket to outward to be continuous along the outer edge so as to be in contact with opposite insides and rear side of the inner case for enhancing close contact with an inside surface of the case. The lip is sloped such that an end thereof is directed, for an example, an outward upper side of the gasket.

The gasket has a top surface sloped such that a height of the outer edge is higher than a height of the inner edge. The gasket is formed of rubber.

The gasket is formed separate from the tray, or formed as a unit with the tray by insert molding.

The cooking chamber assembly may further include an air duct. The air duct is mounted on an upper part of an inside of the case to form a ceiling of the cooking chamber for providing an air circulation passage.

The air duct is fixed to the upper part of the inside of the case directly by means of hooks. The air duct includes a panel, walls, a plurality of apertures for passing circulating air, and a plurality of hooks. The panel forms a ceiling surface of the cooking chamber, and the walls are formed around the panel. The air duct may further include a flange extended horizontally to forward from a top of the front wall. The hooks are extended upward from the wall, elastically.

The case includes a plurality of inserting holes in an upper part for inserting, and fastening the hooks.

The air duct further includes a plurality of projections projected backward from the rear wall opposite to the front wall, and the case further includes a plurality of holes in an inside of rear wall for receiving and holding the projections. The hook is provided to the front wall.

The hook includes an elastic body extended upward from the wall, and a wedge formed head having a predetermined gap between a bottom surface of the head and a top surface of the flange. The gap is preferably the same with, or smaller than a thickness of a part the inserting hole is formed therein. Since the inserting hole is formed in the bracket attached to an inside surface of an upper part of the case, it is preferable that the gap is the same with, or smaller than the thickness of the bracket.

It is to be understood that both the foregoing description and the following detailed description of the present invention are exemplary and explanatory and are intended to provide further explanation of the invention claimed.

BRIEF DESCRITPION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiments of the present invention, examples of which are illustrated in the accompanying drawings. In describing the present invention, same parts will be given the same names and symbols, and repetitive description of which will be omitted.

Figure 1:
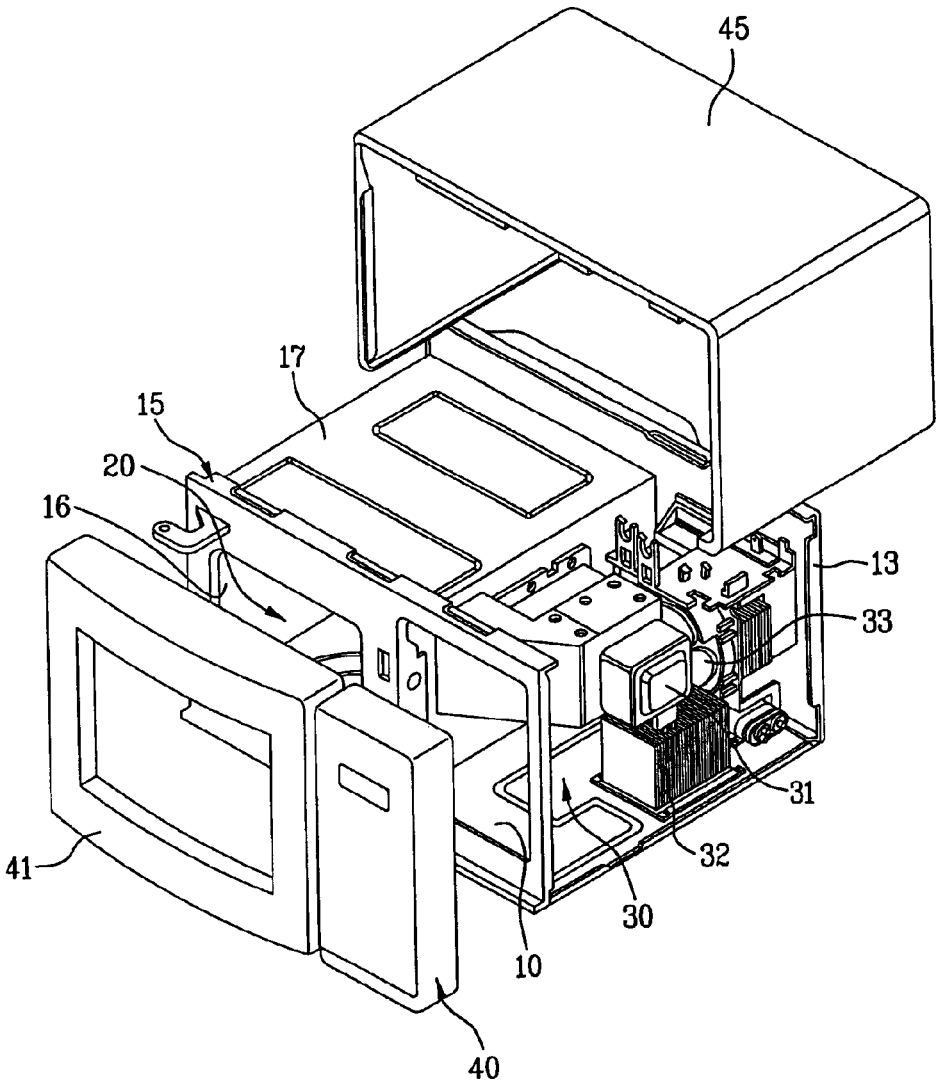
FIG.1 Prior Art
FIG. 1 illustrates a partly disassembled perspective view of a related art microwave oven.
Figure 2:
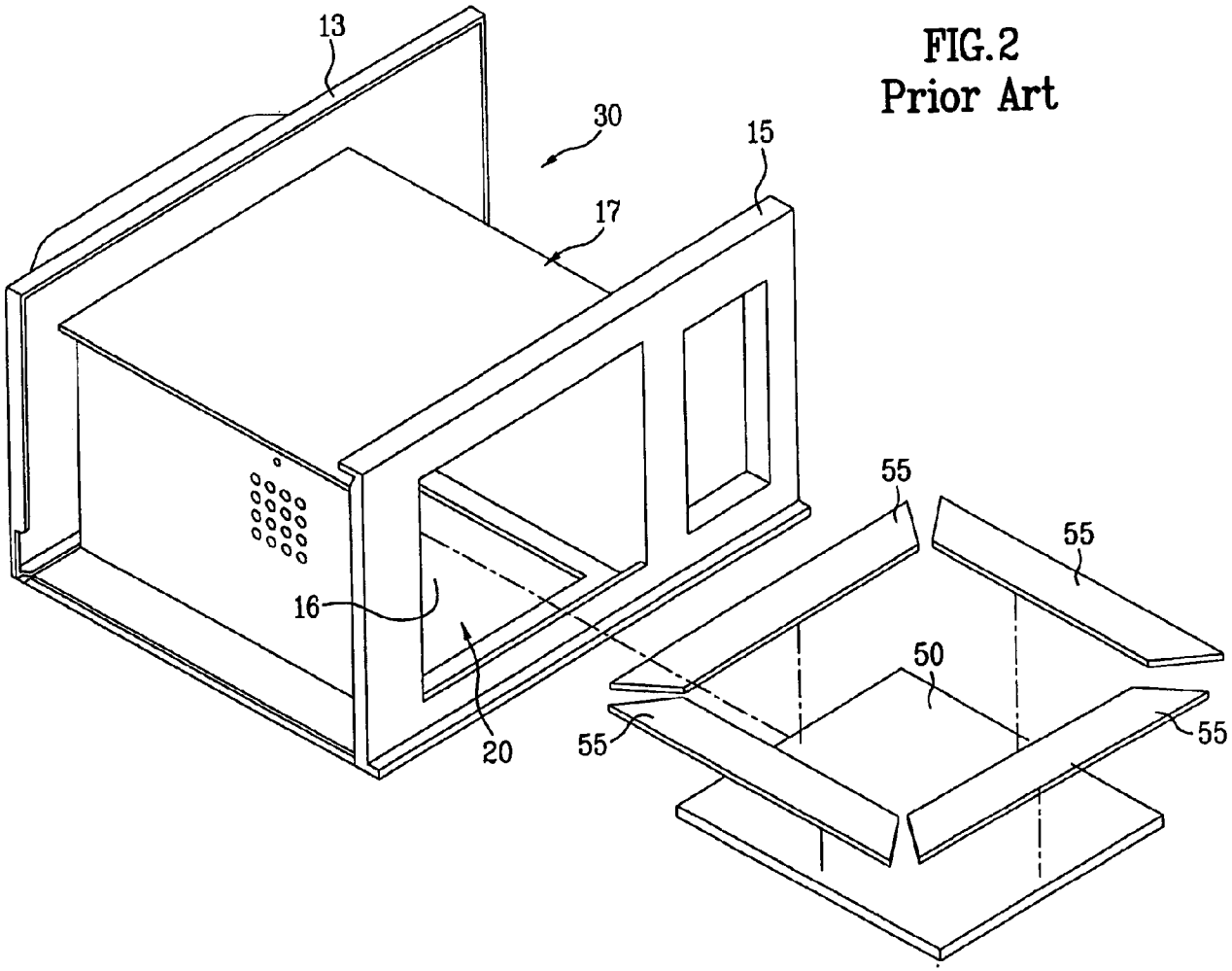
FIG. 2 Prior Art
FIG. 2 illustrates a disassembled perspective view of a sealing structure between walls of an inner case of a related art cooking chamber and a tray, schematically.
Figure 3:
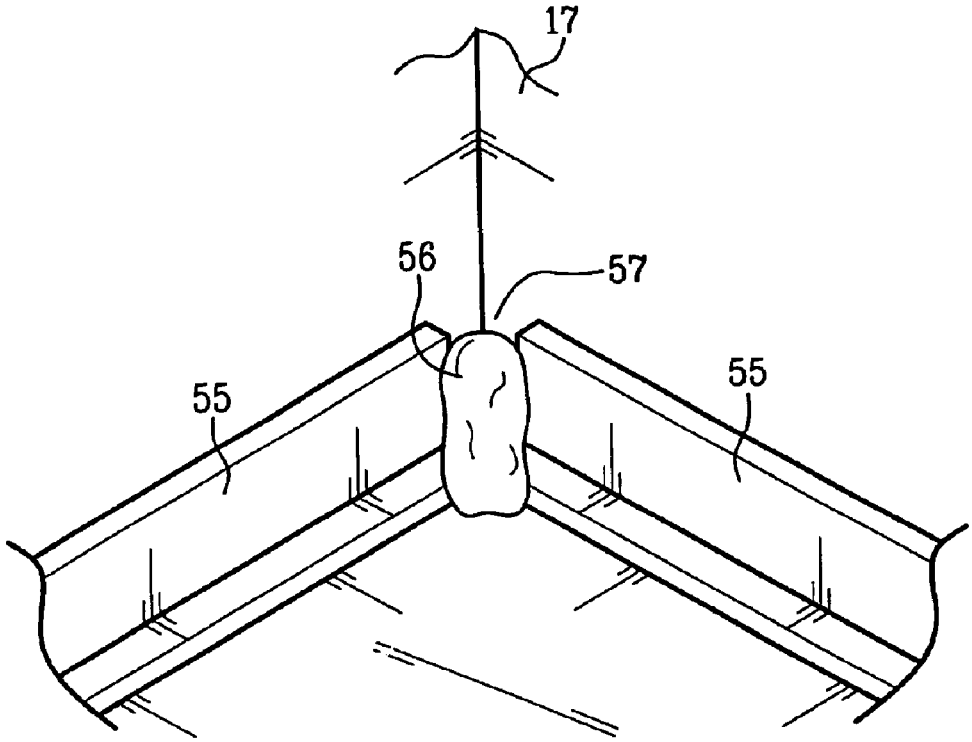
FIG.3 Prior Art
FIG. 3 illustrates a partial perspective view showing a gap between an inner corner of a related art cooking chamber assembly.
Figure 4:
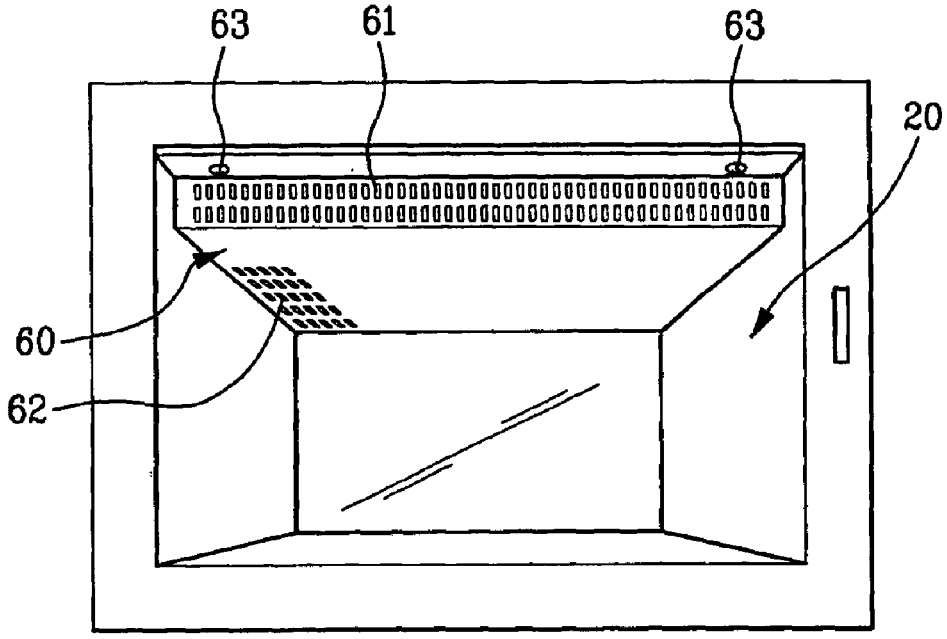
FIG. 4 Prior Art
FIG. 4 illustrates a front view showing an inside of a related art cooking chamber assembly having an air duct provided thereto.
Figure 5:
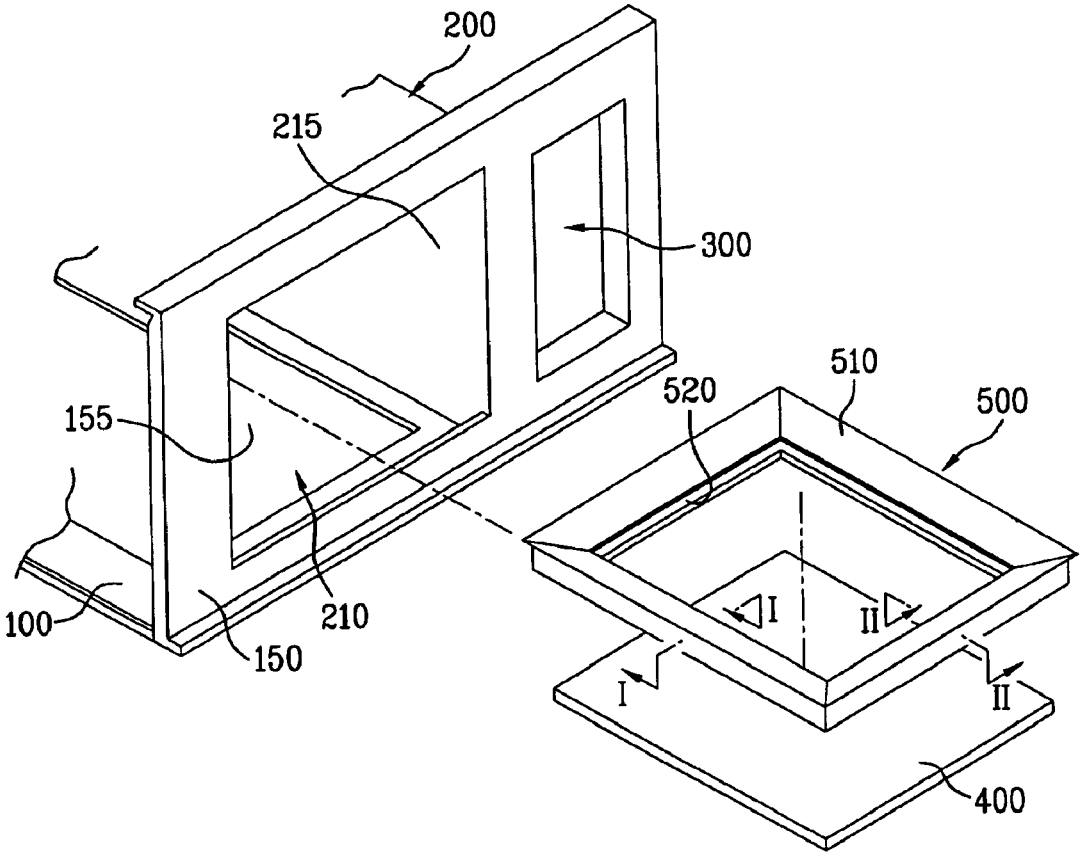
FIG. 5 illustrates a disassembled perspective view showing a ceiling structure between an inner case of a cooking chamber and a tray in accordance with a preferred embodiment of the present invention, schematically.
Figure 6:
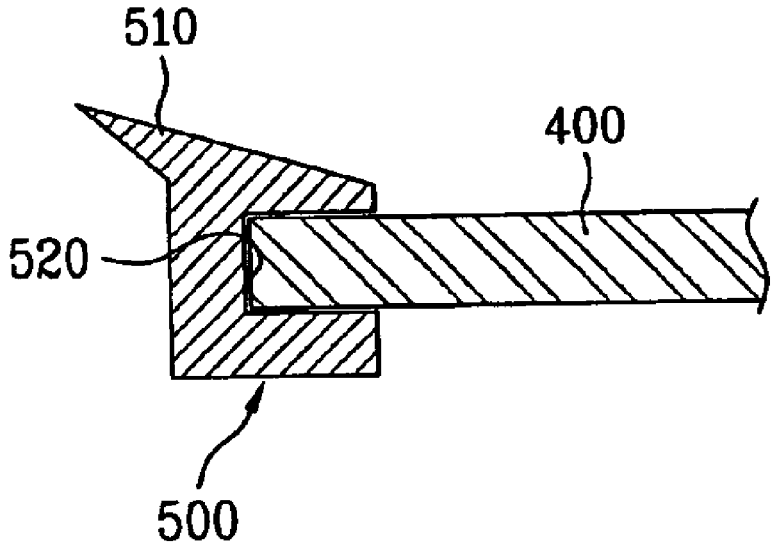
FIG. 6 illustrates a section across a line I—I in FIG. 5.
Figure 7:
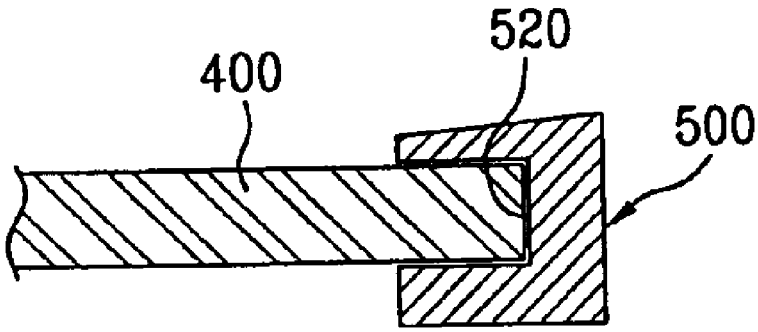
FIG. 7 illustrates a section across a line II—II in FIG. 5.

FIG. 5 illustrates a disassembled perspective view showing a ceiling structure between an inner case of a cooking chamber and a tray in accordance with a preferred embodiment of the present invention schematically, FIG. 6 illustrates a section across a line I—I in FIG. 5, and FIG. 7 illustrates a section across a line II—II in FIG. 5. Those drawings show a tray 400 mounting structure in a cooking chamber assembly of a microwave oven of the present invention, well.

Referring to FIG. 5, the cooking chamber assembly includes an inner case 200, a tray 400, and a gasket 500.

The inner case 200 is mounted on the base plate 100. A cooking chamber 210 is formed inside of the inner case 200. The inner case 200 has an opening 215 in a front part for putting food into, and taking food out of the cooking chamber 210. In the meantime, since a microwave is directed to the cooking chamber 210, the inner case 200 is formed of a material through which no microwave leaks, such as a metal.

Of the upper space of the base plate 100, a space adjacent to the space the inner case 200 occupies is used as an outfit chamber 300. The outfit chamber 300 has a magnetron (not shown) mounted therein for directing a microwave to the cooking chamber. The outfit chamber 300 also has a plurality of electric components including a transformer (not shown) for providing a high voltage to the magnetron. The outfit chamber 300 also has a fan mounted therein (not shown) for cooling the electric components including the magnetron and circulating air inside of the microwave oven.

In the meantime, FIG. 5 illustrates an embodiment the outfit chamber 300 is formed at a side of the inner case 200 of the cooking chamber 210. However, position of the outfit chamber 300 is not limited thereto but the outfit chamber 300 may be formed at upper side or a rear side of the inner case 200.

There is a front plate 150 in front of the inner case 200 and the outfit chamber 300. The front plate 150 has an opening 155 in communication with the opening 215 in the inner case 200.

Though not shown, there is a front panel having a door for closing the openings 215 and 155 in front of the front plate 150. In the meantime, the inner case 200 and the outfit chamber 300 are covered with the outer case (not shown).

The tray 400, in a form of, for an example, a plate, is placed in the inner case 200 and forms a floor of the cooking chamber 210. FIG. 5 illustrates an exemplary tray 400 of a square form to form the floor of the cooking chamber 210 of a hexahedral form. Of course, the tray 400 differs according to a form of the floor of the cooking chamber 210. Though the tray 400 is formed of ceramic, the material of the tray 400 is not limited to the ceramic, but the tray 400 may be formed of a metal.

There is a gasket 500 around the tray 400. As shown in FIG. 5, the gasket 500 has one body of rubber, such as silicone. FIG. 5 illustrates a square gasket 500 having a central opening to surround edges of the tray 400. Of course, a form of an inner edge of the gasket 500 is dependent on the edges of the tray 400, and since a form of an outer edge of the gasket 500 is dependent on a form of an inside wall of the inner case 200 that forms the cooking chamber 210, the form of the gasket 500 is not limited to one illustrated in FIG. 5.

The inner edge of the gasket 500, surrounding the edge of the tray 400, has a groove 520 for enhancing fastening and air tightness. As shown in FIGS. 5 and 6, the groove 520 forms a caved channel along the inner edge of the gasket 500 such that the groove 520 is inserted on the edge of the tray 400.

A part of the outer edge of the gasket 500 is brought into close contact with an inside surface of the inner case 200, wherein a lip 510 is projected from the outer edge of the gasket 500 to outward for enhancing close contact and air tightness. The lip 510 is formed continuous so as to be in contact with opposite insides and rear side of the inner case 200, as best shown in FIG. 6 which is a section across a line I—I in FIG. 5. As shown in FIG. 6, the lip 510 is sloped such that an edge thereof is directed an outward upper side.

In the meantime, there is no lip at a part of the outer edge of the gasket 500 in contact with the opening 155 of the front plate 150. This is for smooth transition from the gasket 500 to the opening 155 of the front plate 150 for convenience of putting in and taking out food. However, when required, the lip 510 may be provided to the gasket 500 that comes into contact with the opening 215 of the inner case 200.

A section of the gasket 500 adjacent to the opening 215 of the inner case 200 is best shown in FIG. 7. As shown in FIGS. 6 and 7 well, an upper surface of the gasket 500 is sloped such that the outer edge is higher than the inner edge, for guiding moisture, evaporated from the food and flowing down along an inside wall of the inner case 200, toward a central part of the tray 400, thereby preventing the moisture from staying on an inside surface of the inner case 200.

The tray 400 and the gasket 500 may be fabricated separately. In this instance, as described with reference to FIGS. 5~7, the tray 400 and the gasket have fastening structures. However, the present invention is not limited to this, but the tray 400 and the gasket 500 may be fabricated as a unit. Because the tray 400 of ceramic or a metal and the gasket 500 of rubber, such as silicone, can be insert molded into one body. That is, after fabricating the tray 400, by putting the tray 400 in a metal mold or the mold, and injecting and hardening liquid rubber, the tray 400 and the gasket 500 can be fabricated as one body. As this process of insert molding is known well, no more description will be given.

When the tray 400 and the gasket 500 of the present invention are mounted on the inside of the inner case 200, that prevents formation of the gap between the gasket 500 and the inner case 200 in advance, water leakage can be prevented. Therefore, the cooking chamber assembly, having the gasket 500 of the present invention applied thereto, even permits washing of the cooking chamber 210, i.e., an inside space of the inner case 200, with water. According to this, the cooking chamber 210 for cooking the food can be maintained much cleaner.

FIGS. 8~10B best shown fastening structures of an air duct 600, which forms a ceiling of the cooking chamber 210 and circulating air in the cooking chamber assembly of the present invention, referring to which a structure for mounting the air duct 600 will be described in more detail.

The air duct 600 is attached to an upper side of an inside of the inner case 200. The panel 610, forming a ceiling surface of the cooking chamber 210, is substantially in a square form. There are a plurality of walls at edges of the panel 610, i.e., one pair of side walls 630, a front wall 620, and a rear wall 640 substantially in vertical. The side walls 630 are in contact with the side walls of the inner case 200.

Figure 8:
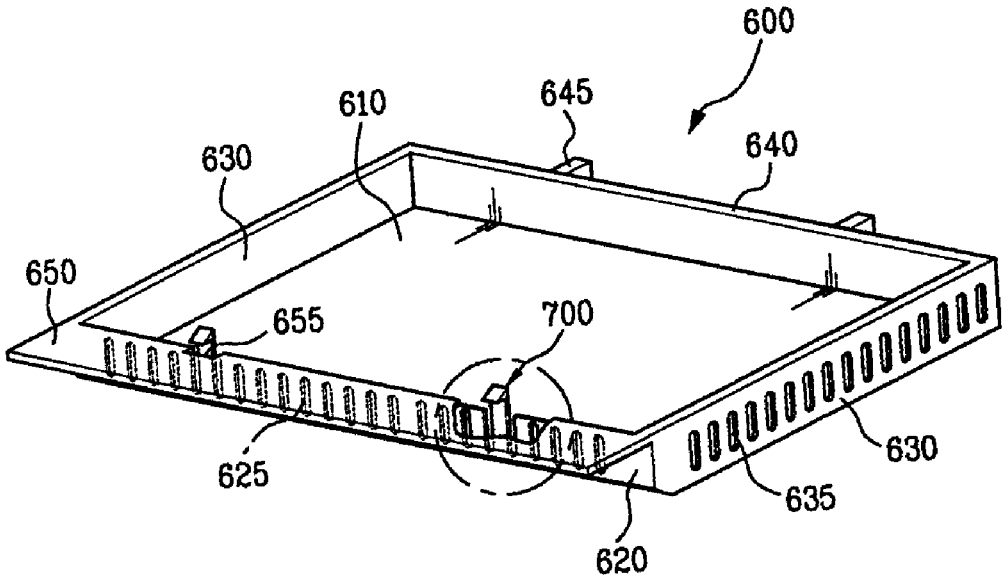
FIG. 8 illustrates a perspective view showing an air duct in a cooking chamber in accordance with a preferred embodiment of the present invention.

The air duct 600 has a plurality of apertures 625 and 635 for passing circulating air, for introducing the air used to cool the components in the outfit chamber 300 into the air duct 600, and therefrom into the cooking chamber 210, and therefrom to an exterior after the air is circulated through the cooking chamber 210. As shown in FIG. 8, the apertures are formed in the sidewalls 630 and the front wall 620, and though not shown, may be formed in the panel 610.

In the case of the apertures 625 and 635 in FIG. 8, the apertures 635 in the sidewalls 630 introduce air from the outfit chamber 300 to the air duct 600, and the apertures 625 in the front wall 620 supply the air introduced into the air duct 600 to the cooking chamber 210. In the meantime, the air circulated in the cooking chamber 210 is exhausted through a plurality of apertures (not shown) in the wall of the inner case 200, such as the rear wall, or in the panel 610. When the air is exhausted through the apertures in the panel 610, there may be a partition (not shown) provided for preventing the exhausting air from mixing with the air introduced into the air duct 600 through the sidewall 630.

In the meantime, as shown in FIG. 8, a flange 650 is extended in a forward direction horizontally from an upper part of top of the front wall 620. Hooks 700 are extended upward from the front wall 620 to have an elasticity, for fastening the air duct 600 to the upper part of the inside of the inner case 200, directly. Detail of the hook 700 is shown in FIGS. 8 and 9.

Referring to FIG. 8, at least two hooks 700 are formed on the front wall 620. However, positions of the hooks 700 are not limited to the front wall 620, but the hooks 700 may be formed on the sidewalls 630 or the rear walls 640, together with the front wall 620. Nevertheless, the hook 700 will be described limited to a case when the hooks 700 are formed on the front wall 620, with reference to FIGS. 8 and 9.

A body 710 of the hook 700 is extended upward from the front wall 620 to a predetermined length. Since the body 710 of the hook 700 has its own elasticity, the body 710 deformed in a front or rear direction, elastically. There is a head 720 on top of the body 710 of the hook 700, and, as shown in FIG. 9, a bottom 725 of the head 720 is flat. There is a gap between the bottom 725 of the head 720 and a top surface of the flange 650.

Figure 9:
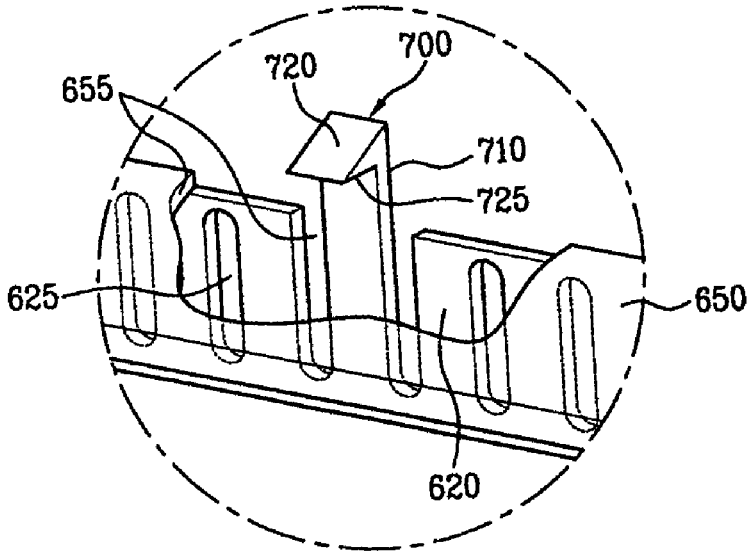
FIG. 9 illustrates an enlarged perspective view of the hook in FIG. 8.

Referring to FIGS. 8 and 9, there is a cutaway part 655 continuous between the flange 650 and the front wall 620, for enhancing the elasticity of the body 710, and securing a space for the hook 700 to move when the body 710 is deformed, elastically. That is, body 710 of the hook 700 is freed from the flange 650 and the front wall 620 by the cutaway part, thereby permitting the body 710 to move in the front or rear direction, elastically.

Figure 10A:
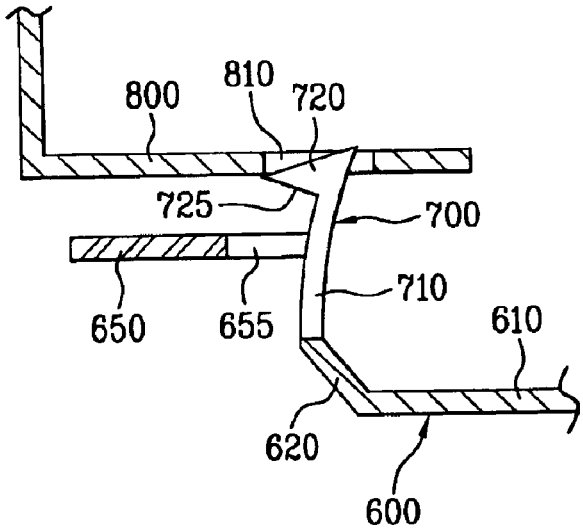
FIGS. 10A and 10B illustrate partial sections each showing the steps of fastening the air duct in FIG. 8.
Figure 10B:
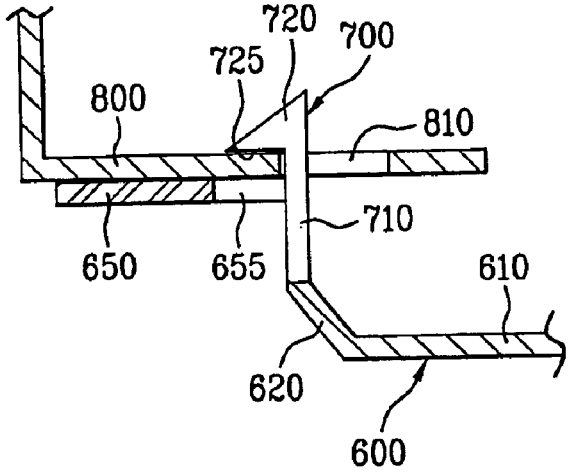

Referring to FIGS. 10A and 10B, the inner case 200 has an inserting hole 810 for fastening the air duct 600 to the inner case 200 with the hook 700. Though the inserting hole 810 can be formed in the inner case 200 directly, the inserting hole 810 may be formed in a separate bracket 800. FIGS. 10A and 10B illustrate an embodiment in which the inserting hole 810 is formed in a bracket 800 attached and fixed to an upper inside surface of the inner case 200, and the hook 700 is inserted in the inserting hole 810. No inner case 200 is shown in the drawings.

It is preferable that the gap between the bottom 725 of the head 720 and the flange 650 is the same or slightly smaller than a thickness of a part in which the inserting hole 810 for inserting the head 720 of the hook 700 is formed therein. In the case of embodiment shown in FIGS. 10A and 10B, it is preferable that the gap is the same with, or slightly smaller than the thickness of the bracket 800. If the gap has a thickness as described above, since a part of the bracket 800 is inserted between the bottom 725 of the head 720 of the hook 700 and the top surface of the flange 650 tightly, a fastening force of the hook 700 can be increased more.

The cooking chamber assembly of the present invention may also include a plurality of projections 645, and a plurality of holes (not shown) for receiving the projections 645. As shown in FIG. 8, the projections 645 are projected backward from the rear wall 640 of the air duct 600. The holes are recessed in an inside surface of the rear of the inner case 200 for receiving and holding the projections. Because the structure having, and joining the projections and the holes thus is apparent to those skilled in the art only with above description, no more detailed description or drawings will be given.

In the cooking chamber assembly of the present invention having the foregoing structure, a process for attaching the air duct 600 to an inside of an upper side of the inner case 200 with the hook 700 will be described, with reference to FIGS. 10A and 10B.

Though not shown, after positioning a mounting position of the air duct 600 by inserting the projections 645 from the rear wall 640 of the air duct 600 in the holes, a front part of the air duct 600 is lifted until the hooks 700 are inserted in the inserting holes 810. In this process, since the top of the head 720 of the hook 700 is sloped, the head 720 of the hook 700 is pushed backward slightly, when an upper part of the body 710 is slightly pushed backward, elastically.

As the head 720 of the hook 700 keeps moving upward, the head 720 is inserted in the inserting hole 810 fully, when the upper part of the body 710 moves forward by an elastic restoring force, according to which the head 720 also moves forward. Then, as shown in FIG. 10B, the bracket 800 is fastened between the bottom of the head 720 and the top surface of the flange 650, the hook 700 is fastened very firmly.

Since there are at least two hooks 700 formed on the front wall 620 of the air duct 600, stable lateral fastening is possible, and a rear side of the air duct 700 is held by the holes and the projections 645, the air duct 600 can maintain the mounted state stably in a state the hooks 700 are inserted in the inserting holes 810.

Because the cooking chamber assembly of the present invention in which the air duct 600 is mounted with the hooks 700 requires no separate fastening members, such as screws or bolts for assembly, assembly and fabrication work are improved very much, to enhances a productivity.

The cooking chamber assembly of the present invention having the foregoing structure has the following advantages.

First, the unitary gasket in the cooking chamber assembly of the present invention provided for prevention of water leakage forms no gap between the inside wall of the cooking chamber and the tray. According to this, a perfect waterproof state can be maintained between inside and outside of the bottom of the cooking chamber, thereby permitting to protect the various electric components against becoming out of order caused by moisture.

Second, the perfect waterproof state maintained between inside and outside of the bottom of the cooking chamber permits cleaning of the cooking chamber assembly with water, that permits to maintain the cooking chamber cleaner.

Third, the unitary gasket permits an easy fitting to the tray, and reduces a fabrication time period as no gap is formed to dispense with sealant application, that permits improvement in productivity. Moreover, if the gasket and the tray are insert molded, the productivity can be improved more.

Fourth, the no necessity for application of sealant to an inside of the cooking chamber improves a sense of beauty.

Fifth, the mounting of the air duct with hooks can dispense with additional fastening members, such as screws or bolts, permitting to reduce an assembly and components costs.

Sixth, the very easy and fast assembly work of the cooking chamber assembly of the present invention permits a fast fabrication without delay, that improves productivity.

It will be apparent to those skilled in the art that various modifications and variations can be made in the present invention without departing from the spirit or scope of the invention. For an example, it is possible that the air duct can be mounted to the inner case only with the hooks without the projections and the holes. In this case, it is preferable that the hooks are formed not only on the front wall, but also sidewalls and rear walls, and according to which the bracket the inserting holes are formed therein are provided additionally for inserting of the additional hooks.

Thus, it is intended that the present invention cover the modifications and variations of this invention provided they come within the scope of the appended claims and their equivalents.

What is claimed is:

1. A cooking chamber assembly for a microwave oven, comprising:

a case having a cooking chamber formed therein and an opening formed in a front portion thereof; and an air duct fixed directly to an upper inside portion of the case by at least one hook, having a bottom surface which forms an upper surface of the cooking chamber, wherein the air duct is configured to form a continuous air circulation passage between an outfit chamber of the microwave oven and the cooking chamber, wherein the air duct comprises a panel which forms a ceiling surface of the cooking chamber, a plurality of walls extending from outer edges of the panel, a plurality of apertures configured to allow air to pass therethrough, and at least one elastic hook extending upward from at least one of the plurality of walls, and wherein the case includes at least one insertion hole formed in an upper portion thereof, wherein the at least one insertion hole is configured to receive and to engage the at least one hook, and the air duct further comprises a plurality of projections which each project outward from a rear wall of a plurality of walls, and wherein the case further comprises a plurality of holes formed in an inner rear wall thereof, wherein each of the plurality of holes is configured to receive and hold a corresponding projection.

2. The cooking chamber assembly as claimed in claim 1, wherein the at least one hook is provided on a front wall of the plurality of walls, and wherein the front wall is adjacent to the opening.

3. The cooking chamber assembly as claimed in claim 2, wherein the air duct further comprises a flange which extends horizontally forward from an upper portion of the front wall.

4. The cooking chamber assembly as claimed in claim 3, wherein the at least one hook comprises:

an elastic body portion configured to extend upward from one of the plurality of walls; and a wedge shaped head, wherein a predetermined gap is formed between a lower surface of the head and an upper surface of the flange.

5. The cooking chamber assembly as claimed in claim 4, wherein the gap is less than or equal to a thickness of a portion of the case where the at least one insertion hole is formed.

6. The cooking chamber assembly as claimed in claim 5, wherein the case includes a bracket provided on an upper surface of an inner portion of the case, wherein the at least one insertion hole is formed in a portion of the bracket.

7. The cooking chamber assembly as claimed in claim 4, further comprising at least one cutaway portion formed in the front wall.

8. The cooking chamber assembly as claimed in claim 7, wherein the at least one elastic hook is formed extending from the front wall.

9. The cooking chamber assembly as claimed in claim 8, wherein the elastic body portion of the at least one elastic hook is configured to flex within a corresponding cutaway portion formed in the front wall.

10. The cooking chamber assembly as claimed in claim 4, wherein a dimension of the cutaway portion formed in the front wall is based on a corresponding dimension of the at least one elastic hook.

11. The cooking chamber assembly as claimed in claim 4, wherein the wedge shaped head is configured to extend beyond an upper surface of the flange.

12. The cooking chamber assembly as claimed in claim 3, wherein an upper portion of the at least one elastic hook is configured to extend beyond an upper surface of the flange.

13. A cooking chamber assembly for a microwave oven, comprising:

a case having a cooking chamber formed therein;

an air duct fitted to an upper inside portion of the case and having a bottom surface which forms an upper surface of the cooking chamber;

at least one insertion hole formed in an upper portion of the case;

at least one hook extended upward from the air duct, and configured to engage the at least one insertion hole;

at least one hole formed in a rear portion of the case; and at least one projection projected outward from a rear portion of the air duct, and configured to engage the at least one hole.

14. The cooking chamber assembly as claimed in claim 13, wherein the air duct is configured to form an air circulation passage between an outfit chamber of the microwave oven and the cooking chamber.

15. The cooking chamber assembly as claimed in claim 3, wherein the at least one hook is extended upward from a front portion of the air duct.

16. The cooking chamber assembly as claimed in claim 13, wherein the air duct comprises:

a panel configured to form the bottom surface thereof;

a plurality of walls extending from outer edges of the panel; and a plurality of apertures configured to allow passage of air therethrough.

17. The cooking chamber assembly as claimed in claim 13, wherein the case includes a bracket provided on an upper surface of an inner portion of the case, wherein the at least one insertion hole is formed in a portion of the bracket.

* * * * *